United States Patent [19]

Diehl et al.

[11] Patent Number: 4,846,900

[45] Date of Patent: Jul. 11, 1989

[54] PROCESS FOR THE PRODUCTION OF A COMPRESSSED GAS CONTAINER MADE OF AUSTENITIC STEELS BY CRYODEFORMATION

[75] Inventors: Werner K. Diehl, Cologne; Martin Kesten, Rosrath, both of Fed. Rep. of Germany

[73] Assignee: Messer Griesheim GMBH, Fed. Rep. of Germany

[21] Appl. No.: 229,836

[22] Filed: Aug. 8, 1988

[30] Foreign Application Priority Data

Aug. 13, 1987 [DE] Fed. Rep. of Germany ..... 3726960

[51] Int. Cl.[4] ..... C21D 8/00

[52] U.S. Cl. ..... 148/125; 72/54

[58] Field of Search ..... 148/12 C, 125; 72/38, 72/54, 56

[56] References Cited

U.S. PATENT DOCUMENTS

| | | | |
|---|---|---|---|
| 3,255,051 | 7/1966 | Gilbert | 148/125 |
| 3,266,946 | 8/1966 | Merlin | 148/125 |
| 4,772,337 | 9/1988 | Kesten | 148/125 |

FOREIGN PATENT DOCUMENTS

| | | | |
|---|---|---|---|
| 236805 | 9/1987 | European Pat. Off. | 148/125 |

*Primary Examiner*—Robert McDowell

*Attorney, Agent, or Firm*—Connolly & Hutz

[57] ABSTRACT

The invention relates to a process for producing a compressed gas container made of austenitic steels by cryodeformation in which the container is cooled by a refrigerated cooling medium to below the prevailing martensite transformation temperature and is expanded to the desired size by the introduction of a pressure medium into the container. Trichlorofluoromethane is employed as the pressure medium.

1 Claim, 1 Drawing Sheet

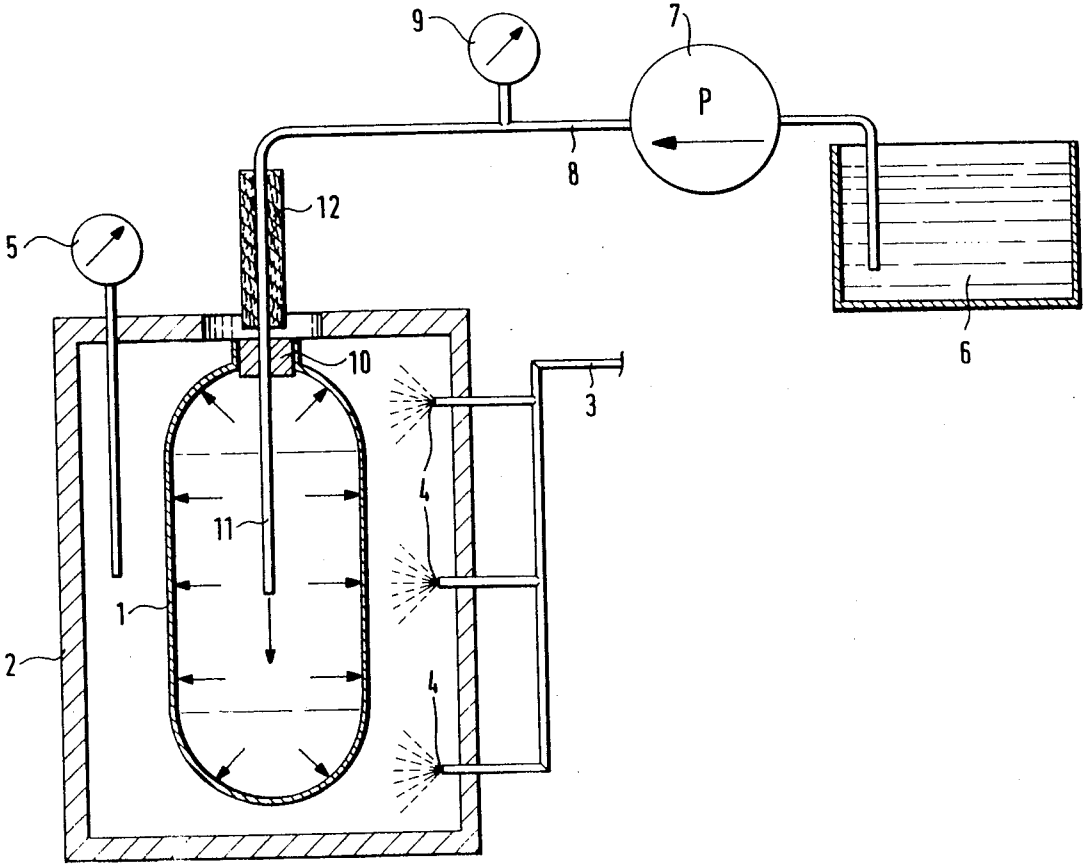
6
7
P
8
9
12
10
11
3
4
4
1
5
2

PROCESS FOR THE PRODUCTION OF A COMPRESSSED GAS CONTAINER MADE OF AUSTENITIC STEELS BY CRYODEFORMATION

BACKGROUND OF THE INVENTION

The strength properties of metastable austenitic steels can be improved by cryodeformation by their deformation below their respective martensite transformation temperature Md or Ms. Md is then the temperature above which a martensitic transformation does not take place even during deformation; Ms, on the other hand, is the temperature below which, even without deformation, the martensite formation begins. Such a process for the improvement of the strength properties of austenitic steels is also known from German DE-PS No. 26 54 702.

Since, in particular, the Ms temperatures are very low, the preferred employed cooling medium is liquid nitrogen which can be used to cool the steels if so desired to −196° C.

The application of this process for the production of high strength pressure containers is known, moreover, from German DE-OS No. 1 452 533. The simultaneous use of liquid nitrogen as a cooling medium and pressure medium is then preferred. In this case, the container to be deformed is filled with liquid nitrogen and, by means of an appropriate cryopump or by gas pressurization, is brought to the high pressure required for the deformation. The use of a pressure medium which is different from the cooling medium is also mentioned but appears to be too expensive, for example, in the form of explosion deformation or undesirable condensations from the pressure medium can be expected, possibly a freezing up of the pressure medium with excessive cold extraction from the container wall.

In practice, however, the simultaneous application of liquid nitrogen as cooling and pressure medium has resulted in a number of disadvantages and problems.

When the pressure is transferred to the container wall via the liquid nitrogen as medium, the use of expensive heat-insulated apparatus such as cryopumps, insulated pipelines and cryocontainers is required. Gas pockets either produced on purpose or formed unavoidably in the container or its feed lines increase the safety risk if the container should fail during the cryostretching process. In addition, the liquid nitrogen per se at the relatively high, required stretching presusres (several 100 bar) also has a marked compressibility which in the case of failure clearly increases the released energy. Expensive safety devices which inhibit the industrial application of the process are, therefore, required for cryostretching.

SUMMARY OF INVENTION

The invention is, therefore, based on the objective of improving the process for the production of compressed gas containers made of austenitic steels by cryodeformation in such a way that it does not have the disadvantages mentioned for the simultaneous application of the cooling medium as pressure medium nor the described problems produced when a separate pressure medium is used.

The properties of the trichlorofluoromethane $CFCl_3$ known as a refrigerant under the designation R 11, employed according to the invention make its use possible as a separate pressure medium independent of the cooling medium although this can actually not be expected based on the temperature range in which it is present as a liquid.

Trichlorofluoromethane solidifies at a temperature which is clearly higher than the temperature at which the cryostretching is conducted because of the expedient use of liquid nitrogen as a cooling medium.

It is liquid at room temperature so that it can be forced into the container to be deformed with a normal hydraulic pump. That it can maintain this aggregate state during cryostretching, in spite of the fact that the container to be deformed is cooled externally with liquid nitrogen, results from its low heat conductivity and high specific heat as compared to steel.

$\lambda$steel (−196° C.)~6[W/mK]; $\lambda CFCl_3$(−120° C.) <0.2[W/mK]$cp_{steel}$(−196° C.)=0.15 [J/gk]; $cp CFCl_3$(−120° C.)=0.79 [J/gK]

These properties prevent a rapid temperature equalization between the container wall, cooled externally and the pressure medium in the container.

In addition to trichlorofluoromethane, other chlorofluorohydrocarbons such as dichlorofluoromethane ($CCl_2F_2$, R 12) and chlorotrifluoromethane ($CClF_3$, R 13) are, in principle, also suitable as pressure medium for cryostretching of containers. But these have the disadvantage that they are no longer liquid at room temperature and normal ambient pressure but must be kept under higher pressure.

THE DRAWING

The single FIGURE schematically illustrates an apparatus for the implementation of the process according to an exemplified embodiment of the invention.

DETAILED DESCRIPTION

The compressed gas container 1 to be deformed is located in an insulated cooling chamber 2 in which it is cooled to the temperature required for the formation of martensite. Liquid nitrogen is used as cooling medium which is sprayed through the line 3 and jets 4 into the cooling chamber 2 where it evaporates. The attained temperature is indicated by the thermometer 5. According to the invention, the required deformation pressure is applied with $CFCl_3$ as pressure medium which comes from a tank 6 and is forced inside the container 1 by means of the pump 7 via the line 8. The pressure is indicated by the manometer 9.

The filled compressed gas container 1 is closed with a removable pressure-tight closure 10 and connected with the pump 7 and the line 8 via a filling pipe 11 projecting to the center of the container. At the entrance to the compressed gas container 1, the filling pipe 11 has a thermal insulation 12 which prevents the pressure medium from freezing up. The safety arrangements required to implement the process according to the invention do not go beyond the measures usual for routine hydrostatic testing of containers.

Since $CFCl_3$ has a distinctly lower heat conductivity than the steel of the container, only a boundary layer coming into immediate contact with the inside surface of the container can solidify during the deformation process. The cooling chamber 2 can, therefore, also be replaced by a liquid nitrogen-filled Dewar vessel into which the container 1 is dipped. Even under these extreme conditions, the process of the invention can be implemented provided that the container 1 is not dipped into the liquid nitrogen any longer than necessary for the deformation.

What is claimed is:

1. In a process for the production of a compressed gas container made of austenitic steels by cryodeformation including the steps of cooling the compressed gas container in liquid nitrogen to below the prevailing martensite transformation temperature and expanding the container to the desired size by introducing a pressure medium into the container, the improvement being in that trichlorofluoromethane ($CFCL_3$) is introduced as the pressure medium.

* * * * *